US010863783B2

(12) United States Patent
Gatto et al.

(10) Patent No.: US 10,863,783 B2
(45) Date of Patent: Dec. 15, 2020

(54) PROTECTIVE APPAREL WITH ANGLED STRETCH PANEL

(75) Inventors: Jeanne Marie Gatto, Alpharetta, GA (US); Christina Mae Chingren Seward, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1162 days.

(21) Appl. No.: 11/735,738

(22) Filed: Apr. 16, 2007

(65) Prior Publication Data

US 2008/0250553 A1 Oct. 16, 2008

(51) Int. Cl.
*A41D 13/02* (2006.01)

(52) U.S. Cl.
CPC ..... *A41D 13/02* (2013.01); *A41D 2300/22* (2013.01); *A41D 2400/52* (2013.01)

(58) Field of Classification Search
CPC ..... A41D 13/02; A41D 2300/22; A41D 13/1209; A41D 13/015; A41D 2400/52
USPC .... 2/455, 456, 457, 46, 71, 72, 76, 79, 227, 2/901
See application file for complete search history.

(56) References Cited

U.S. PATENT DOCUMENTS

| | | | |
|---|---|---|---|
| 1,012,648 | A | 12/1911 | Karp |
| 1,139,999 | A | 5/1915 | Rosenthal |
| 1,277,074 | A | 8/1918 | Hitzeman |
| 1,426,540 | A | 8/1922 | Bernstein |
| 1,489,046 | A | 4/1924 | Thompson |
| 1,609,286 | A | 12/1926 | Bernstein |
| 1,714,491 | A | 5/1929 | Burr |
| 1,744,695 | A | 1/1930 | Fishback et al. |
| 1,973,419 | A | 9/1934 | Trageser |
| 2,087,246 | A | 7/1937 | Edwards |
| 2,087,763 | A | 7/1937 | Liebmann |
| 2,115,974 | A | 5/1938 | Harris et al. |
| 2,380,423 | A | 7/1945 | Freedman |
| 2,465,286 | A | 3/1949 | Jules Silver |
| 2,500,084 | A | 3/1950 | Metzger |
| 2,541,713 | A | 2/1951 | Neilson |
| 2,569,643 | A | 10/1951 | Spare |
| 2,664,570 | A | 1/1954 | Artzt |

(Continued)

FOREIGN PATENT DOCUMENTS

| | | |
|---|---|---|
| CA | 803714 | 1/1969 |
| CN | 1082129 A | 2/1994 |

(Continued)

OTHER PUBLICATIONS (Off the Cuff Sewing Style, "How to Use It" . . . Elastic!, Aug. 21, 2005, http://off-the-cuff-style.blogspot.com/2005/08/how-to-use-it-elastic.html).*

(Continued)

*Primary Examiner* — Nathan E Durham
*Assistant Examiner* — Abby M Spatz
(74) *Attorney, Agent, or Firm* — Dority & Manning, P.A.

(57) ABSTRACT

A disposable protective apparel garment having an angled elastomeric panel present on the back side of the garment is described. The garment, such as protective coveralls, includes an elastomeric panel in a V-shaped configuration that extends from the lower back upwardly toward the underarms and along the sleeves. Such an elastomeric panel allows the wearer a greater degree of movement when wearing such a garment.

19 Claims, 4 Drawing Sheets

(56) References Cited

U.S. PATENT DOCUMENTS 2,730,723 A 1/1956 Jonsson
2,839,756 A 6/1958 Geiss
2,854,670 A 10/1958 Naccash
2,986,740 A 6/1961 Schudson
2,994,089 A 8/1961 Ferguson, Jr. et al.
3,013,276 A 12/1961 Maxwell
3,086,214 A 4/1963 Lash
3,110,903 A 11/1963 Burchard
3,276,944 A 10/1966 Levy
3,338,992 A 8/1967 Kinney
3,341,394 A 9/1967 Kinney
3,502,538 A 3/1970 Petersen
3,502,763 A 3/1970 Hartmann
3,542,615 A 11/1970 Dobo et al.
3,692,618 A 9/1972 Dorschner et al.
3,703,008 A 11/1972 Hudson
3,720,957 A 3/1973 Patience
3,849,241 A 11/1974 Butin et al.
4,041,203 A 8/1977 Brock et al.
4,117,552 A 10/1978 Simpson
4,302,847 A 12/1981 Miles
4,340,563 A 7/1982 Appel et al.
4,374,888 A 2/1983 Bornslaeger
4,412,357 A 11/1983 Mincher
4,455,683 A 6/1984 Moretti
4,466,137 A 8/1984 Carnaghi
4,473,908 A 10/1984 Knecht
4,485,489 A 12/1984 Pilie et al.
4,494,248 A 1/1985 Holder
4,523,337 A 6/1985 Leibowitz
4,525,407 A 6/1985 Ness
4,601,066 A 7/1986 Campbell
4,655,760 A 4/1987 Morman et al.
4,657,802 A 4/1987 Morman
4,660,227 A 4/1987 Abramson
4,670,913 A 6/1987 Morell et al.
4,677,696 A 7/1987 Tanaka
4,683,595 A 8/1987 Cash
4,718,122 A 1/1988 Steverson
4,720,415 A 1/1988 Vander Wielen et al.
D295,575 S 5/1988 Campbell
4,753,843 A 6/1988 Cook et al.
4,781,966 A 11/1988 Taylor
4,789,699 A 12/1988 Kieffer et al.
4,791,681 A 12/1988 Dean
4,791,685 A 12/1988 Maibauer
4,860,382 A 8/1989 Markwell
4,890,337 A 1/1990 Greenberg
4,894,867 A 1/1990 Ceravolo et al.
4,922,551 A 5/1990 Anthes
4,965,122 A 10/1990 Morman
4,981,747 A 1/1991 Morman
4,985,937 A 1/1991 Blackburn
4,999,850 A 3/1991 Grilliot et al.
5,007,112 A 4/1991 Lewis, Jr. et al.
5,008,962 A 4/1991 Smith et al.
5,033,127 A 7/1991 Schmelz
5,088,116 A 2/1992 Gould
5,097,534 A 3/1992 Viemeister et al.
5,170,506 A 12/1992 Lewis, Jr. et al.
5,182,812 A 2/1993 Goldsby
5,213,881 A 5/1993 Timmons et al.
5,226,992 A 7/1993 Morman
D341,919 S 12/1993 Grimes
5,315,716 A 5/1994 Baum
5,336,545 A 8/1994 Morman
5,343,564 A 9/1994 Reynolds et al.
5,359,731 A 11/1994 Cavilier
5,361,411 A 11/1994 Bohn et al.
5,401,446 A 3/1995 Tsai et al.
5,414,867 A 3/1995 Bowling et al.
5,426,787 A 6/1995 Freeman
D364,493 S 11/1995 Williams
5,487,189 A 1/1996 Bell
5,491,753 A 2/1996 Van Hout et al.
5,492,753 A 2/1996 Levy et al.
5,504,944 A 4/1996 Bromer et al.
5,509,142 A 4/1996 Connell et al.
5,555,561 A 9/1996 Plachta
5,575,010 A 11/1996 Chung
5,582,903 A 12/1996 Levy et al.
5,586,339 A 12/1996 Lathan
5,608,913 A 3/1997 Lacoste
5,611,087 A 3/1997 Adkins
5,640,715 A 6/1997 Adams
5,652,961 A 8/1997 Knight-Yurt
5,694,645 A 12/1997 Triplette
5,695,849 A 12/1997 Shawver et al.
5,706,523 A 1/1998 Witzel
5,717,999 A 2/1998 Lurry
5,720,042 A 2/1998 Wilkinson
5,724,674 A 3/1998 Covington et al.
5,737,773 A * 4/1998 Dicker et al. ..... 2/69
5,778,452 A 7/1998 Dicker et al.
5,829,059 A * 11/1998 Covington, Jr. ..... A41D 13/02 2/79
5,839,122 A * 11/1998 Dicker et al. ..... 2/67
5,842,959 A 12/1998 Wilkinson
5,867,827 A 2/1999 Wilkinson
5,875,491 A 3/1999 Wilkinson
5,887,279 A 3/1999 Elting et al.
5,894,600 A 4/1999 Chenefront
5,978,966 A 11/1999 Dicker et al.
6,029,274 A 2/2000 Welchel et al.
6,047,406 A 4/2000 Dicker et al.
6,053,852 A 4/2000 Wilkinson
D426,050 S 6/2000 Bowen
6,076,187 A 6/2000 Wallerstein
6,119,270 A 9/2000 Chou
6,158,056 A 12/2000 Riley
6,209,144 B1 4/2001 Carter
6,286,145 B1 * 9/2001 Welchel ..... A41D 31/02 2/69
6,289,524 B1 * 9/2001 Wright ..... A41D 13/015 2/455
6,311,333 B1 11/2001 Batra
6,353,934 B1 3/2002 Tada et al.
6,374,414 B1 4/2002 Collier
6,412,115 B1 7/2002 Pontes et al.
6,460,198 B1 10/2002 Dilworth, Jr. et al.
6,543,062 B1 4/2003 Amsel et al.
6,611,964 B2 9/2003 Lipsett et al.
6,671,884 B1 1/2004 Griesbach III et al.
6,675,389 B1 1/2004 Kublick
6,735,785 B2 5/2004 Takayama
6,738,984 B2 5/2004 Gillen et al.
6,799,331 B2 10/2004 Griesbach, III et al.
6,966,070 B2 11/2005 Gillen et al.
7,013,488 B2 3/2006 Lewis et al.
7,062,786 B2 6/2006 Stinton
7,168,103 B2 1/2007 Aldridge et al.
2002/0138893 A1 10/2002 Culhane
2003/0028950 A1 2/2003 Walsh
2004/0006815 A1 1/2004 Carroll et al.
2004/0078865 A1 4/2004 Culhane
2005/0059940 A1 3/2005 Schulson
2005/0097659 A1 5/2005 Aroch et al.
2005/0125873 A1 * 6/2005 Lewis ..... A41D 13/1209 2/69
2005/0166298 A1 8/2005 Pieroranzio
2005/0188450 A1 9/2005 Clark
2006/0064797 A1 3/2006 Pyeatt Rowe et al.
2006/0107434 A1 5/2006 Rowe et al.
2006/0107437 A1 5/2006 Griesbach, III et al.

FOREIGN PATENT DOCUMENTS

DE 040302713 4/2004
EP 0765128 B1 8/1998
EP 0549954 B1 5/1999
EP 000057682 11/2003
EP 1609380 A1 12/2005

(56) References Cited

FOREIGN PATENT DOCUMENTS

| | | |
|---|---|---|
| GB | 2043430 | 10/1980 |
| GB | 2294864 | 5/1996 |
| WO | WO 98/21989 | 5/1998 |

OTHER PUBLICATIONS

Lawrence, K.D. et al., NRL Report 5265, "An Improved Device for the Formation of Superfine Thermoplastic Fibers", Feb. 1959.
Tilley, Alvin R., The Measure of Man and Woman, John Wiley & Sons, Inc., 2002, 16 pages.
Wente, V.A. et al., NRL Report 4364, "Manufacture of Super-Fine Organic Fibers", May 1954.
Federal Test Method Standard No. 191A, Method 5450, "Permeability to Air; Cloth; Calibrated Orifice Method", Jul. 1978.
AATCC Test Method 127-1998, "Water Resistance: Hydrostatic Pressure Test," 1998, pp. 211-212.
ASTM Designation: D737-96, "Standard Test Methods for Air Permeability of Textile Fabrics", Published Apr. 1996, pp. 207-211.
ASTM Designation: E 96-80, "Standard Test Methods for Water Vapor Transmission of Materials", Published Feb. 1981, pp. 87-96.
ASTM Designation: E171-94 (Reapproved 2002), "Standard Specification for Standard Atmospheres for Conditioning and Testing Flexible Barrier Materials," Published Jan. 1995, (previous edition approved in 1987 as E 171-87), 1 page.

* cited by examiner

PROTECTIVE APPAREL WITH ANGLED STRETCH PANEL

BACKGROUND

There are many types of limited-use or disposable protective apparel designed to provide barrier properties. One type of protective apparel is protective coveralls. Coveralls can be used to effectively seal off a wearer from a harmful environment in ways that open or cloak style garments such as, for example, drapes, gowns and the like are unable to do. Accordingly, coveralls have many applications where isolation of a wearer is desirable. Protective apparel keeps clothing clean and keeps dirt and other residue off of the wearer's skin. For a variety of reasons, it is undesirable for hazardous liquids and/or pathogens that may be carried by liquids to pass through protective apparel. It is also highly desirable to use protective apparel to isolate persons from dusts, powders, and other particulates that may be present in a work place or accident site. Conversely, in cleanroom environments, the protective apparel protects the environment from dust and debris that may otherwise be carried into the environment by the wearer.

In general, workers typically change their coverall once a day, or every other day, depending on the requirements or standards of their respective industry. In some situations, workers may change their protective apparel even more frequently. After use, it can be quite costly to decontaminate protective apparel that has been exposed to hazardous substances. Thus, it is important that protective apparel be inexpensive so as to be disposable. Generally speaking, protective coveralls are made from barrier materials/fabrics engineered to be relatively impervious to liquids and/or particulates. The cost of such materials as well as the coveralls' design and construction are important factors affecting cost. Desirably, all of these factors should be suited for the manufacture of protective apparel, such as coveralls, at such low cost that it may be economical to discard the coveralls, if necessary, after only a single use.

Protective apparel must be worn correctly to reduce the chance of exposure. Workers are more likely to wear protective apparel properly if the apparel is comfortable. Unfortunately, typical disposable protective apparel used in various industrial or healthcare environments often does not fit well against all areas of a wearer's body. Materials commonly used to fabricate such disposable apparel are not stretchy or flexible. To accommodate movement, current coverall designs tend to be larger in the waist and torso regions. This excess material results in baggy, bulky, and uncomfortable garments that can get in the way as the wearer performs tasks. Some wearers use tape to gather excess material and hold it closer to the body. Such worker modifications to garments are time consuming and result in garments that appear sloppy and not at all flattering to the wearer. Moreover, the excess material may form folds, creases or other material configurations that contribute to poor fit and may dangerously be caught against machinery or torn by obstructions.

Even when the worker has a garment that fits (whether by its design or due to the worker's modifications), the garment may be uncomfortable when performing regular tasks. A worker often will have to reach, bend down, or perform other activities in which the material of the garment will be stressed. Such stresses in the materials of the garment will either restrict the movement of the worker or, if pressed to its limits, may cause the material to tear. Such restriction in motion of the worker affects the worker's comfort and directly reduces their productivity. If the materials of the garment are stressed to the point of failure, the garment will often have to be replaced, which contributes to reduced productivity, increased overall costs and may dangerously expose the worker to the environment.

A common method to attempt to reduce (relieve) such restrictive stresses is to construct the garment out of an elastomeric or recoverable-stretch material so that when the fabric is subjected to the restrictive stresses, the fabric elongates. Various elastomeric nonwoven materials and fabrics are available for such purpose, including laminates of a nonwoven webs and elastomeric films. However, a drawback of making an entire garment, or entire panel portions, of an elastomeric material is that such materials are significantly more costly, and thus adds to the overall cost of the product. Solutions utilizing elastomeric panels in multiple discrete points of stress increase the complexity of the garment design and subsequently increase the costs associated with such a garment.

Definitions

As used herein, the term "nonwoven-based material" or "nonwoven web" refers to a material or web that has a structure of individual fibers or filaments which are interlaid, but not in an identifiable repeating manner. Nonwoven webs have been, in the past, formed by a variety of processes known to those skilled in the art such as, for example, meltblowing, spunbonding and bonded carded web processes.

As used herein, the term "spunbonded web" refers to a web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

As used herein, the term "meltblown fibers" means fibers formed by extruding a molten thermoplastic material through a plurality of fine, usually circular, die capillaries as molten threads or filaments into a high-velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "microfibers" means small diameter fibers having an average diameter not greater than about 100 microns, for example, having a diameter of from about 0.5 microns to about 50 microns, more specifically microfibers may also have an average diameter of from about 1 micron to about 20 microns. Microfibers having an average diameter of about 3 microns or less are commonly referred to as ultra-fine microfibers. A description of an exemplary process of making ultra-fine microfibers may be found in, for example, U.S. Pat. No. 5,213,881.

As used herein, the terms "sheet" and "sheet material" shall be interchangeable and in the absence of a word modifier, refer to a material that may be a film, nonwoven web, woven fabric or knit fabric.

As used herein, the term "machine direction" (hereinafter "MD") refers to the planar dimension of a material web, which is in the direction of a material parallel to its forward direction during processing. The term "cross-machine direction" (hereinafter "CD") refers to the planar dimension of a material, which is in the direction that is generally perpendicular to the machine direction.

As used herein, the term "liquid resistant" refers to material having a hydrostatic head of at least about 25 centimeters as determined in accordance with the standard hydrostatic pressure test AATCCTM No. 1998 with the following exceptions: (1) the samples are larger than usual and are mounted in a stretching frame that clamps onto the cross-machine direction ends of the sample, such that the samples may be tested under a variety of stretch conditions (e.g., 10%, 20%, 30%, 40% stretch); and (2) the samples are supported underneath by a wire mesh to prevent the sample from sagging under the weight of the column of water.

As used herein, the term "breathable" refers to material having a Frazier porosity of at least about 25 cubic feet per minute per square foot (cfm/ft$^2$). For example, the Frazier porosity of a breathable material may be from about 25 to more than 45 cfm/ft$^2$. The Frazier porosity is determined utilizing a Frazier Air Permeability Tester available from the Frazier Precision Instrument Company. The Frazier porosity is measured in accordance with Federal Test Method 5450, Standard No. 191A, except that the sample size is 8"×8" instead of 7"×7".

As used herein, the term "particle resistant" refers to a fabric having a useful level of resistance to penetration by particulates. Resistance to penetration by particulates may be measured by determining the air filter retention of dry particles and can be expressed as particle holdout efficiency. More specifically, particle hold-out efficiency refers to the efficiency of a material at preventing the passage of particles of a certain size range through the material. Particle holdout efficiency may be measured by determining the air filter retention of dry particles utilizing tests such as, for example, IBR Test Method No. E-217, Revision G (1/15/91) performed by InterBasic Resources, Inc. of Grass Lake, Mich. Generally speaking, high particle holdout efficiency is desirable for barrier materials/fabrics. Desirably, a particle resistant material should have a particle holdout efficiency of at least about 40 percent for particles having a diameter greater than about 0.1 micron. LMS Labs are used to substantiate claims made in catalog. The apparel catalog references air permeability ASTM D737 and Moisture Vapor Transport Rate ASTM E96 as methods related to comfort properties.

As used herein, the term "elastomeric" refers to a material or composite which can be extended or elongated by at least 25% of its relaxed length and which will recover, upon release of the applied force, at least 10% of its elongation. It is generally preferred that the elastomeric material or composite be capable of being elongated by at least 100%, recover at least 50% of its elongation. An elastomeric material is thus stretchable and "stretchable", "elastomeric", and "extensible" may be used interchangeably.

As used herein, the terms "elastic" or "elasticized" means that property of a material or composite by virtue of which it tends to recover towards its original size and shape after removal of a force causing a deformation.

As used herein, the term "necked-bonded" laminate refers to a composite material having an elastic member that is bonded to a non-elastic member while the non-elastomeric member is extended in the machine direction creating a necked material that is elastic in the transverse or cross-direction. Examples of necked-bonded laminates are disclosed in U.S. Pat. Nos. 4,965,122; 4,981,747; 5,226,992; and 5,336,545.

As used herein, the term "stretch-bonded" laminate refers to a composite material having at least two layers in which one layer is a gatherable layer and the other layer is an elastic layer. The layers are joined together when the elastic layer is in an extended condition so that upon relaxing the layers, the gatherable layer is gathered. For example, one elastic member can be bonded to another member while the elastic member is extended at least about 25% of its relaxed length. Such a multiplayer composite elastic material may be stretched until the non-elastic layer is fully extended. Examples of stretch-bonded laminates are disclosed, for example, in U.S. Pat. Nos. 4,720,415, 4,789,699, 4781,966, 4,657,802, and 4,655,760.

As used herein, the term "disposable" is not limited to single use articles but also refers to articles that are so relatively inexpensive to the consumer that they can be discarded if they become soiled or otherwise unusable after only one or a few uses.

As used herein, the term "garment" refers to protective garments and/or shields including for example, but not limited to surgical gowns, patient drapes, work suits, coveralls, jumpers, aprons, an the like.

As used herein, the term "coverall" refers to a relatively loose fitting, one-piece, protective garment that can be worn over other articles of clothing and protects substantial areas of a wearer's body, typically, from the neck region over the trunk of the body and out to the ends of extremities, such as a wearer's wrists and ankles, which sometimes may include the hands and feet. In some embodiment, the garment may include an attached head cover, such as a hood, or integrated gloves and socks, boots, or other footwear.

As used herein, the term "polymer" generally includes, but is not limited to, homopolymers, copolymers, such as, for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to, isotactic, syndiotactic and random symmetries.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates or materials added to enhance ability to process of a composition.

As used herein, the term "couple" includes, but is not limited to, joining, connecting, fastening, linking, or associating two things integrally or interstitially together. As used herein, the term "releaseably connect(ed)" refers to two or more things that are stably coupled together and are at the same time capable of being manipulated to uncouple the things from each another.

As used herein, the term "configure" or "configuration" means to design, arrange, set up, or shape with a view to specific applications or uses. For example: a military vehicle that was configured for rough terrain; configured the computer by setting the system's parameters.

As used herein, the term "substantially" refers to something which is done to a great extent or degree; for example, "substantially covered" means that a thing is at least 95% covered.

As used herein, the term "alignment" refers to the spatial property possessed by an arrangement or position of things in a straight line or in parallel lines.

As used herein, the terms "orientation" or "position" used interchangeably herein refer to the spatial property of a place where or way in which something is situated; for example, "the position of the hands on the clock."

SUMMARY OF THE INVENTION

In light of the problems discussed above, a need exists for an inexpensive disposable protective garment that allows for easy movement of the wearer during normal working activities. For example, a need exists for protective coveralls that efficiently utilizes an economical amount of elastomeric materials.

The present invention is directed to a unique configuration for a protective garment, particularly a coverall design, that has the benefits of elastomeric materials without the significant costs associated with conventional elastomeric material coveralls. The disposable protective garment of the invention includes body portions, leg portions, sleeve portions, and at least one elastomeric strip. The elastomeric strip is configured to extend from a lower back point upward to the left underarm and from the left underarm along the underside of the left sleeve. The strip also extends upward from the lower back point to the right underarm and from the right underarm along the underside of the right sleeve. The elastomeric strip joins an upper portion of the coveralls body to the leg portions.

Such an elastomeric strip may be a continuous strip of elastomeric material without a seam or may be multiple strips. Additionally, the strip may be between about 2 and 6 inches wide and may have an elastic elongation between about 25 percent and 400 percent. Also, the elastomeric strip may be made of an elastomeric material having a single-direction of stretch, multiple-directions or stretch, or combinations of strips having single-direction and/or multi-direction stretch. Such directional stretch may be aligned along the orientation of the elastomeric strip on the garment, may be aligned parallel with a line generally extending from the collar of the garment to the crotch, or may be made of multiple strips where the stretch is aligned in different directions.

In various garments, the elastomeric strip may be oriented upon the garment to form an angle between the portion of the strip extending toward the left underarm and the portion of the strip extending toward right underarm. When the garment is held flat, such an angle formed by the elastomeric strip may be between about 83 degrees to about 155 degrees. Such an angle may be between about 90 and 150 degrees. In other garments, the angle may be between about 95 degrees and 130 degrees.

The present invention is also directed to a disposable protective coverall formed from barrier fabric including an elastomeric strip configured on the back side to form a V-shape. The V-shape includes an apex positioned at a lower back point, a first extension extending from the apex toward the right underarm, and a second extension extending from the apex toward the left underarm.

For some such coveralls, the first and second extensions extends to the respective underarms and along the underside of the respective sleeves. For some coveralls, the extensions may alternatively extend along the back side of the sleeves or may alternatively extend along the upper edge of such sleeves. Such extensions may extend along the sleeves all the way to the wrists.

Additionally, the extensions of the V-shape form an angle. That angle may be between about 83 degrees to about 155 degrees for some the coveralls. The angle may alternatively be between about 90 degrees and 150 degrees, or may alternatively be between about 95 degrees and 130 degrees.

DETAILED DESCRIPTION

The present invention pertains to a limited-use, preferably disposable, non-laundered protective coverall having an elastomeric strip configured in an angle across the back of the garment. Such coveralls are of particular interest to work areas and industries such as, for example, healthcare, home improvement do-it-yourself, chemical, industrial, sanitation, cleanrooms, and other similar applications. The elastomeric strip permits a wearer to more easily flex his or her upper torso, arms and shoulders, when bending forward or laterally along longitudinal directions. The elastomeric materials of the elastomeric strip have single-directional or multi-directional stretch properties. The elastomeric strip material enhances the overall comfort, fit, and conformance of the garment to the wearer's body. Positioning of stretchable fabric material at particular angles provide necessary elasticity and flexibility for a wearer's movements, allows the amount of loose fabric in the garment to be minimized, and provides a stylish appearance to the garment. With improved fit, increased freedom of movement, and a more stylish look, such garments may improve the wearer's compliance and willingness to don such a protective garment.

Figure 1:
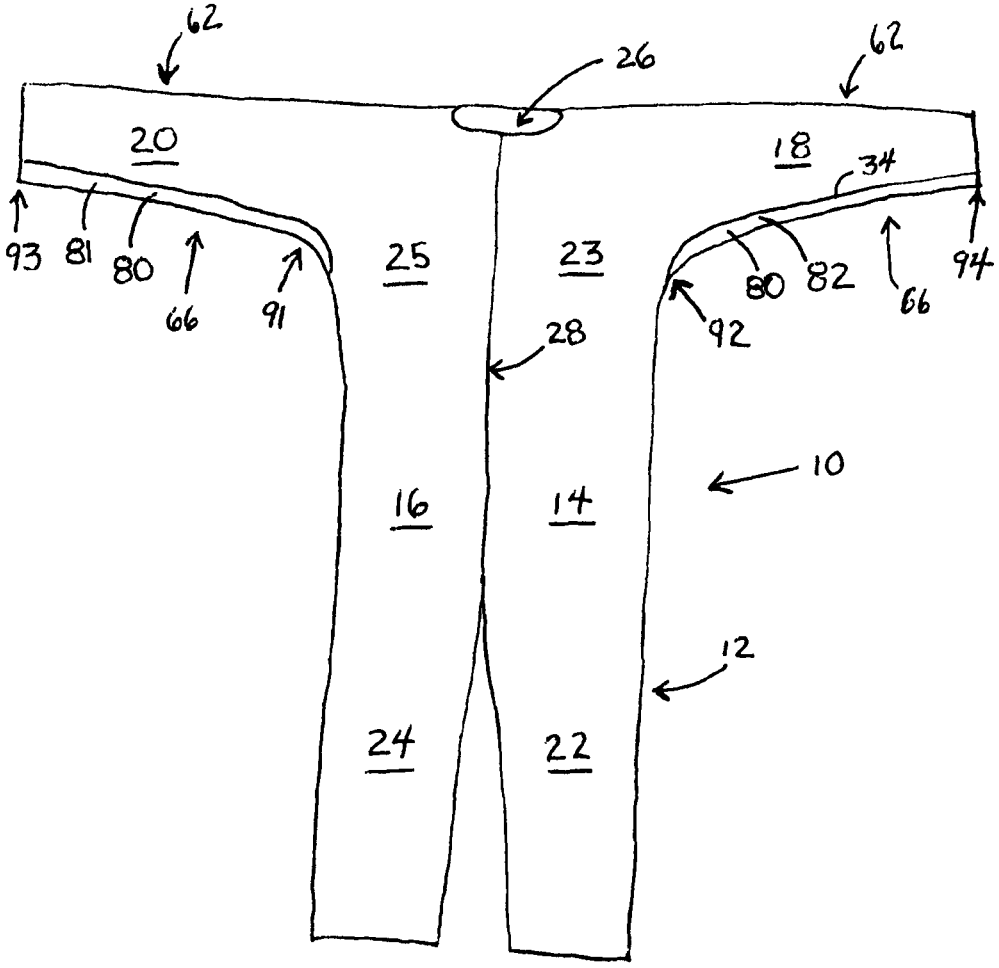
FIG. 1 illustrates a front view of exemplary protective coveralls according to the present invention.

Turning to FIG. 1, there is shown a front view 10 of a coverall 12 embodying the present invention. The protective coveralls 12 include a left body panel 14 and a right body panel 16. It is desirable that each body panel 14, 16 is formed from a seamless sheet of material. The right body panel 16 is substantially a mirror image of the left body panel 14. The protective coveralls 12 include left and right sleeves 18, 20 as well as left and right legs 22, 24. A neck opening 26 is visible at the top of the coveralls 12. As shown in FIG. 1, a closure means 28 extends from the neck opening 26 toward the crotch of the coveralls 12.

The manufacture of such coveralls may be in accordance with known automated, semi-automated, or hand assembly procedures. It is desired that the disposable protective coveralls contain the fewest practical number of panels, portions or sections in order to reduce the number of seams in the garment for better barrier properties and to simplify the manufacturing steps. However, it is contemplated that the disposable protective coveralls of the present invention may contain sections, panels, or portions of barrier fabrics that may have different degrees of strength to customize the coverall for a particular application. For example, the sleeve portions or other portions (e.g., leg portions, shoulder portions or back portions of the coveralls) may include double layers of barrier fabrics with very high levels of strength and toughness.

Figure 2:
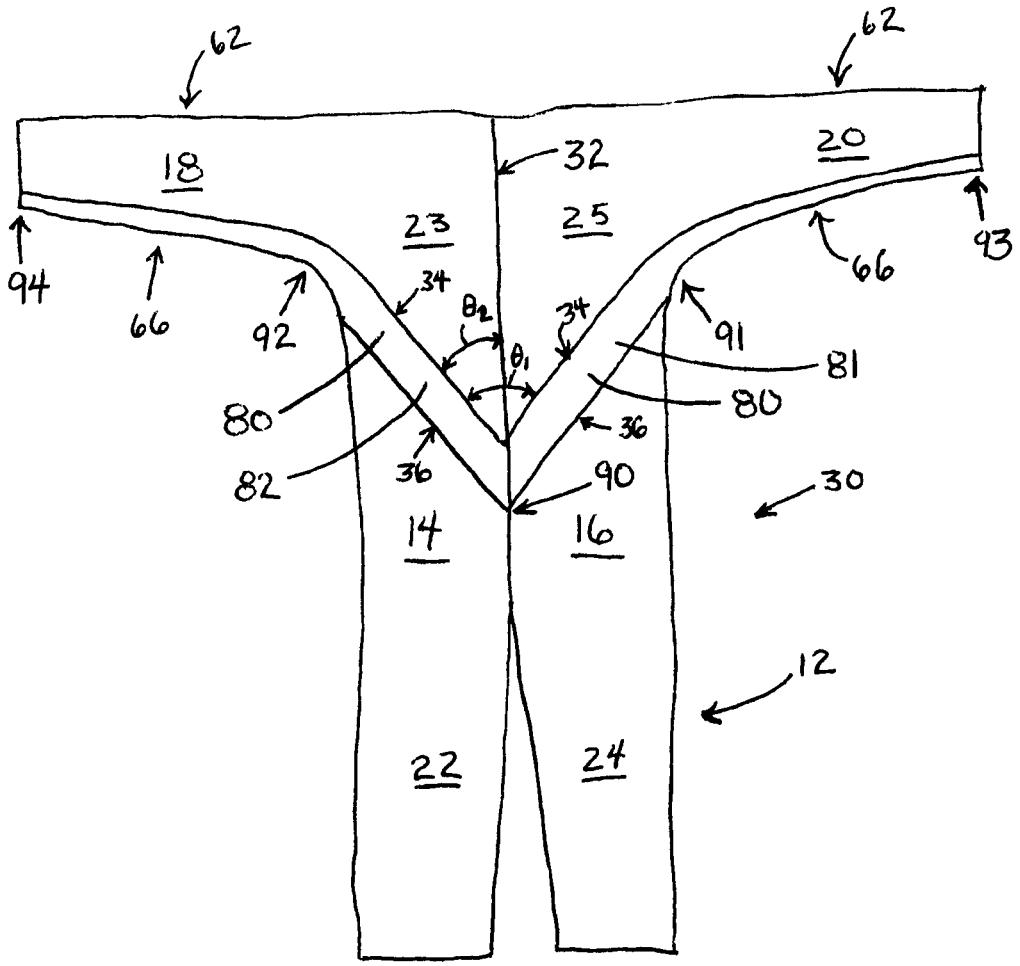
FIG. 2 illustrates a rear view of the exemplary protective coveralls of FIG. 1.

Desirably, the left sleeve 18 may be an integral part of the left body panel 14 (i.e., the left body panel 14 cut to form a left sleeve 18). It is contemplated that the left sleeve 18 may be a separate piece of material that may be joined to the left body panel 14 by a seam (not shown). In the same way, it is desirable that the right sleeve 20 may be an integral part of the right body panel 16 (i.e., the right body panel 16 cut to form a right sleeve 20). It is contemplated that the right sleeve 20 may be a separate piece of material that may be joined to the right body panel 16 by a seam (not shown). A closure means 28 joins the left body panel 14 to the right body panel 16 on the front 10 of the coveralls 12. As shown in FIG. 2, a vertical back seam 32 joins the body panels 14, 16 to each other on the back 30 of the coveralls 12.

In the coveralls 12 illustrated in FIGS. 1 and 2, the sleeves 18, 20 are shown as extending outward from the body substantially parallel with the shoulder portions. However, other designs are possible, For example, the coveralls 12 illustrated in FIG. 3 includes sleeve 18, 20 that are designed to extend upward from the general plane of the shoulder portions.

Desirably, the legs 22, 24 are formed in a way similar to the formation of the sleeves 18, 20. Desirably, the left leg 22 may be an integral part of the left body panel 14 (i.e., the left body panel 14 cut to form a left leg 22). It is contemplated that the left leg 22 may be a separate piece of material that may be joined to the left body panel 14 by a seam (not shown). In the same way, it is desirable that the right leg 24 may be an integral part of the right body panel 16 (i.e., the right body panel 16 cut to form a right leg 24). It is contemplated that the right leg 24 may be a separate piece of material that may be joined to the right body panel 16 by a seam (not shown).

Desirably, the left body panel 14 and the right body panel 16 are constructed such that the left and right upper sections 23, 25 and the left and right leg sections 22, 24 of the coveralls 12 corresponding to the left and right body panels 14, 16 are each made from single, or integral, pieces of material. Although less desirable, it is contemplated that seams (not shown) may be used to join the upper sections 23, 25 to the leg sections 22, 24, to join the sleeves 18, 20 to the upper sections 23, 25, or to join combinations thereof.

FIG. 2 illustrates a rear view 30 of the exemplary protective coveralls 12 of FIG. 1. The protective coveralls 12 includes a left body panel 14 and a right body panel 16 (in reversed position as the view is from the rear). The left and right sleeves 18, 20 and the left and right legs 22, 24 are also in reversed position.

The back 30 of the coveralls 12 also includes an elastomeric strip 80, which gives the wearer of such coveralls 12 increased ability to bend over, reach, stoop, and overall improved movement. The elastomeric strip 80 is generally oriented on the back 30 of the coveralls 12 in a V-shape configuration from the lower back 90, or lumbar region, of the coveralls 12 and upward toward the right and left underarms 91, 92 of the coveralls 12. The elastomeric strip 80 further extends from the underarms 91, 92 of the coveralls 12 and down the undersides 66 of the sleeves 18, 20. When viewed from the front 10, only a portion of the elastomeric strip 80 along the left and right sleeves 18, 20 is visible. When viewed from the rear 30, the V-shape is clearly visible and become more pronounced if the wearer were to lift their arms upward; when the wearer puts their arms to their sides, the elastomeric strip 80 appears as M-shaped, when viewed from the rear 30.

For the coveralls 12 illustrated in FIGS. 1 and 2, the elastomeric strip 80 is made up of a first elastomeric strip 81 and a second elastomeric strip 82. The first elastomeric strip 81 extends upward from a point on the lower back 90 at the back seam 32, along the right body panel 16, to the right underarm 91 and down the underside 66 of the right sleeve 20 toward the right wrist 93. Similarly, the second elastomeric strip 82 extends upward from the lower back point 90 at the back seam 32, along the left body panel 16, to the left underarm 92 and down the underside 66 of the left sleeve 18 toward the left wrist 94.

The elastomeric strip 80 is desirably attached to the body panels 14, 16 in such a way as to allow the elastomeric strip 80 to easily stretch with the movements of the wearer. For the coveralls 12 of FIGS. 1 and 2, the first elastic strip 81 is attached to an edge of the right upper section 25, along the upper seam 34, and is also attached to and edge of the right leg section 24, along the lower seam 36. Likewise, the second elastic strip 82 is attached to an edge of the left upper section 23 along the upper seam 34 and is also attached to an edge of the left leg section 24 along the lower seam 36.

Such first and second elastomeric strips 81, 82 may be attached to the coveralls 12 while being held in a stretched configuration as the upper and lower seams 34, 36 are made. After the seams 34, 36 are completed the elastomeric strips 81, 82 may then be released and allowed to retract along with the coveralls 12. Such stretching of the elastomeric material during construction of the garment will depend on the elongation and retraction properties of the particular elastomeric material used, the manufacturing capabilities, and the desired design.

The first and second elastomeric strips 81, 82 are shown in FIGS. 1 and 2 as extending all the way along the undersides 66 of the sleeves 18, 20 to the wrists 93, 94 of the coveralls 12. It is contemplated that the elastomeric strip 80 may extend only partially down the sleeves 18, 20. For example, the coveralls 12 illustrated in FIG. 3 includes first and second elastomeric strips 81, 82 that only extend down the undersides 66 of the respective right and left sleeves 20, 18 to a point between the right and left elbows 95, 96 and the right and left wrists 93, 94.

Figure 3:
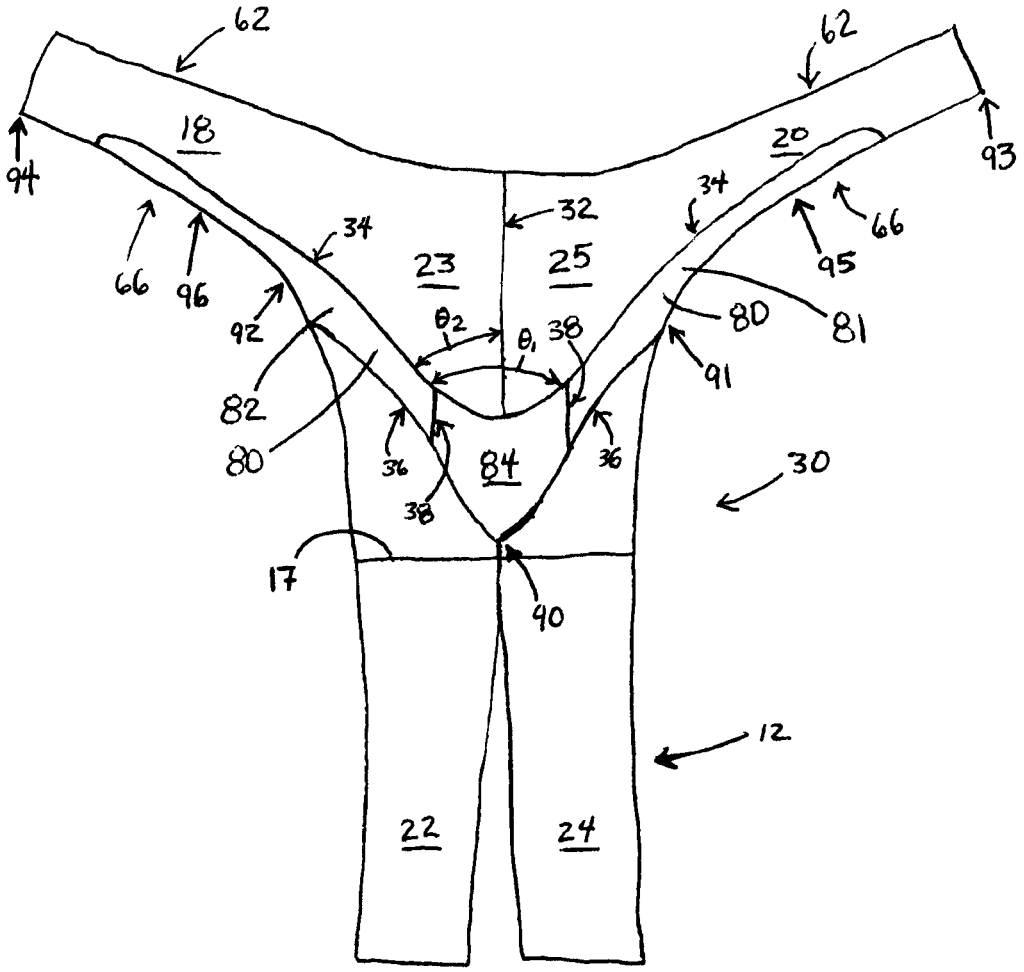
FIG. 3 illustrates a rear view of exemplary protective coveralls according to the present invention.
Figure 4:
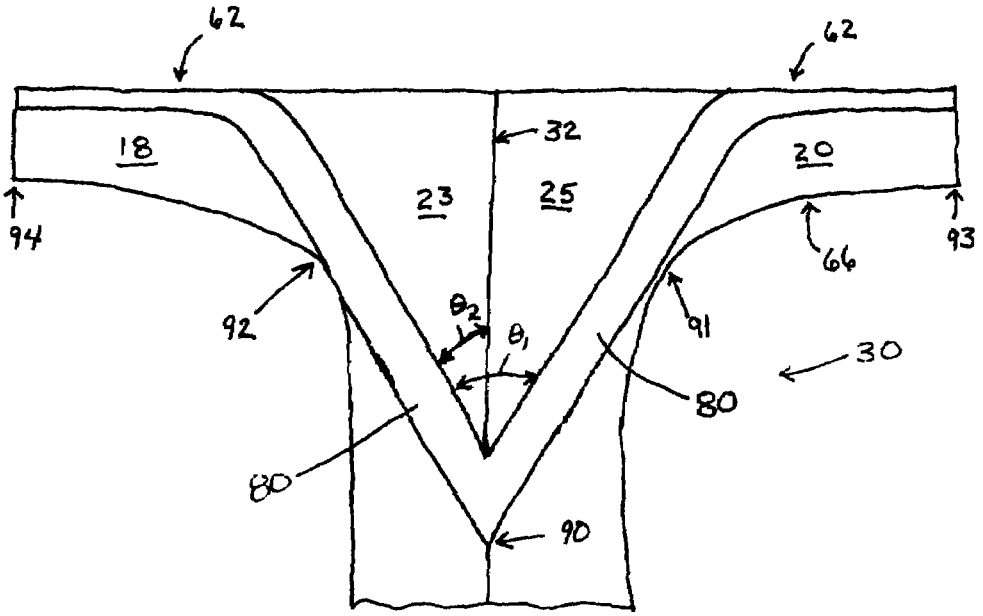
FIG. 4 illustrates a detail of exemplary disposable protective coveralls according to the present invention.
Figure 5:
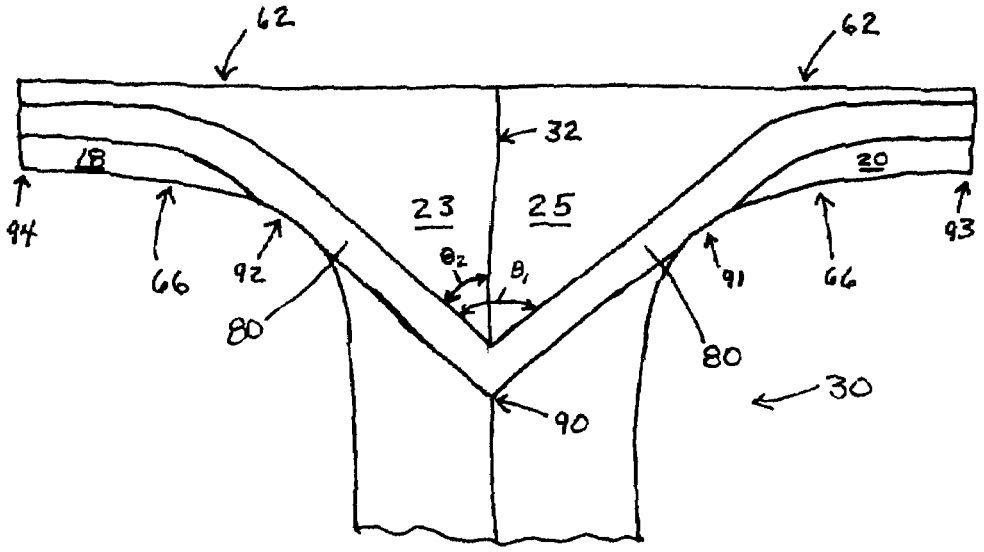
FIG. 5 illustrates a detail of exemplary disposable protective coveralls according to the present invention.

Rather than extending down the undersides 66 of the sleeves, as shown in FIGS. 2 and 3, the elastomeric strip may extend along the sleeves in alternate configurations. As illustrated in FIG. 4, the elastomeric strip 80 may extend upwardly from the lower back 90 toward the left and right underarms 92, 91 and then extend along the back side 30 of the left and right sleeves 18, 20. Alternatively, as illustrated in FIG. 5, the elastomeric strip 80 may extend upwardly from the lower back 90 toward the left and right underarms 92, 91 and then extend along the upper edge 62 of the left and right sleeves 18, 20.

The use of an elastomeric strip 80 allows for a garment construction that provides the wearer with increased flexibility, reach and overall movement. However, such elastomeric materials are often expensive and their use needs to be minimized in a protective garment intended to be economical, yet disposable. To that end, the present invention uses a discrete elastomeric strip in a particular configuration to take advantage of human physiology, while minimizing costs. Rather than using whole panels of elastomeric materials, the elastomeric strip is sized large enough to provide at least a minimum level of available elongation and yet is small enough to provide such elongation economically. With such a balance in mind, the width of the elastomeric strip is desirably in the range of about 2 inches to about 6 inches. Desirably, the elastomeric strip will be about 2 inches to about 4 inches in width.

It is also desirable that the elastomeric strip(s) be capable of elongating in the range of about 100% to about 300% (i.e., about a 2 times to about 4 times increase in length when stretched). However, in some embodiments the design of the coveralls 12 and the orientation of the direction of stretch of the elastomeric strip may prevent full utilization of a material's available elongation. In such designs, it may be more cost effective and efficient to utilize an elastomeric material having a lower level of elongation. For example, the desired level of elongation may be greater than or equal to about 25%. Materials having elongations from about 25% to about 300% are contemplated for use as the elastomeric strip(s) of the present invention.

To maximize the ability of the elastomeric strip of the coveralls 12 of the present invention to stretch, the elastomeric strip is desirably free of seams, or materials, which would span across the elastomeric strip. For the coveralls 12 illustrated in FIG. 2, only a single seam, the vertical back seam 32, spans across the elastomeric strip 80. (The vertical back seam 32 actually joins the first elastomeric strip 81 to the second elastomeric strip 82 in the coveralls 12 of FIG. 2.) It is contemplated that the vertical back seam 32 could be removed from the back of the coveralls 12 of FIG. 2 and the two elastomeric strips 81, 82 could be replaced by a single elastomeric strip that, without an intervening seam. Examples of coveralls having such a seamless elastomeric strip 80 are illustrated in FIGS. 4 and 5.

Alternate designs of an elastomeric strip are also contemplated. For example, the coveralls 12 illustrated in FIG. 3 include the general V-shaped configuration of the elastomeric strip of the present invention. However, an elastomeric lumbar panel 84 is included in the lower back area 90, taking up the apex of the V-shape. The first elastomeric strip 81 extends from the lumbar panel 84 toward the right underarm 91 and along the underside 66 of the right sleeve 20. In the same way, the second elastomeric strip 82 extends from the left side of the lumbar panel 84 upwardly toward the left underarm 92 and along the underside 66 of the left sleeve 18.

The upper edge of the elastomeric lumbar panel 84 is attached to an edge of both upper sections 23, 25 by the upper back seam 34. The lower edge of the elastomeric lumbar panel 84 is attached to an edge of both leg portions 22, 24 by the lower back seam 36. The elastomeric strips 81, 82 are attached to the lumbar panel 84 by the lumbar seams 38 on either side of the elastomeric lumbar panel 84.

As shown in FIG. 3, the elastomeric lumbar panel 84 may be larger in its width than the width of the elastomeric strips 81, 82. Additionally, the lumbar panel 84 may be contoured or shaped to maximize its fit with the lumbar region of the wearer of such coveralls 12. It is also contemplated that such a lumbar panel 84 may be an integral portion of the elastomeric strip 80. In such embodiments, the lumbar panel 84 may be a contoured, or widened, portion of the elastomeric strip 80 in the lower back area 90 of the coveralls 12.

The V-shape of the elastomeric strip 80 of the present invention is configured to provide increased flexibility and movement to allow the wear of such coveralls 12 to be able to reach, bend over at the waist, or bend along the spine with greater ease than is available in garments that lack such an elastomeric strip. As previously discussed, this is accomplished by providing elastomeric materials that extend from the lumbar region of the back upwardly to the underarms and along the sleeves, forming the desired V-shape. The apex of the V-shape is generally anticipated to correspond with the area of the lumbar vertebra of the wearer, but may be lower than the waist or may even be located in an area as high as the lower thoracic vertebra of the wearer.

The extensions of V-shape extend from the apex at an angle $\theta_1$, relative to each other, and at an angle $\theta_2$ to the vertical center (i.e., the vertical back seam 32 of the garments illustrated in FIGS. 2 and 3) of the back 30 of the coveralls 12. The angle $\theta_2$ is one-half of the total angle $\theta_1$ between the extensions of the elastomeric V-shape. While the angle $\theta_2$ is shown in FIGS. 2 and 3 as the angle between the vertical back seam 32 and the upper back seam 34 of the second elastomeric strip 82, it should be understood that the angle $\theta_2$ should be understood to be one-half of the effective angle $\theta_1$ between the extensions of the V-shape formed by the elastomeric strips 81, 82. For elastomeric strips that do not have uniform width, the angle $\theta_1$ of the V-shape is the angle between the axis that runs along the effective centers of the portions of the elastomeric strip 80 extending from the lower back 90 towards the right and left underarms 91, 92 of the coveralls 12.

The angle $\theta_1$ of the V-shape is desirably designed to encompass the general range of sizes of persons that will wear such the coveralls 12. The inventors approximated the necessary V-shape angle $\theta_1$, and the related angle $\theta_2$, of the elastomeric strip 80 utilizing data regarding body measurement distributions for men and women in the U.S. population. See "The Measure of Man and Woman," by Alvin R. Tilley, 2002. Specifically, the inventors utilized size distribution data to design the elastomeric strip angle to account for 98 percent of the U.S. population (i.e., taking account for the $1^{st}$-percentile man, $1^{st}$-percentile woman, $99^{th}$-percentile man, and $99^{th}$-percentile woman).

Utilizing data regarding the shoulder-to-shoulder width, torso depth (chest to back), and shoulder cap width, the torso circumference may be approximated. Specifically, the upper human torso may be approximated as an ellipse. One half of such an estimated circumference can then be used to estimate the width between the ends of the extensions of the desired V-shape. Additionally, data regarding the thoracic link height (i.e., measure along the 12 thoracic vertebra of the spine) may be used to estimate the perpendicular height from the apex of V-shape to the segment spanning between the ends of the V-shape's extensions. This height and width forms an imaginary inverted triangle on the back of the coveralls. Using the thoracic link height and the estimated width, as calculated above, the angles $\theta_1$ and $\theta_2$ can be calculated. See Table 1 for the estimates.

Such body data allows the calculation of the theoretical angles for body dimensions alone, but may not fully account for the required dimensions of such protective coveralls. An additional variance factor is necessary to account for the clothes of the wearer. Several more inches are also included in the chest width estimate to accommodate donning and removal of the coveralls. Increasing the torso width estimate by as much as six to eight inches may be appropriate.

Similarly, due to design choose in the garment, the actual placement of the apex of the V-shape may fall higher or lower on the coveralls. This may be done due to the coverall design not necessarily being proportional in height:width ratio for the various sizes of coveralls offered. Additionally, or alternatively, the placement of the apex may be placed higher or lower, based on the balance of movement that is desired to be accommodated. For example, if more reach movement was desired, the apex may fall higher on the back; if more waist bending movement is desired, the apex may fall lower. Thus, one may wish to use a height greater or lesser than the thoracic link height used in the theoretical body calculations. Based on design needs it is contemplated that apex of the V-shape may be placed six to eight inches higher, or lower, than the thoracic link height would suggest. Such larger chest dimensions combined with a higher or lower apex provides slightly different estimates for the angles $\theta_1$ and $\theta_2$. See Table 1 for these additional estimates.

TABLE 1

| Percentile | Estimated torso span (mm) | Length of thoracic link (mm) | Estimate based on body data | | Estimate with larger chest and higher V-shape | | Estimate with larger chest and lower V-shape | |
|---|---|---|---|---|---|---|---|---|
| | | | $\theta_2$ | $\theta_1$ | $\theta_2$ | $\theta_1$ | $\theta_2$ | $\theta_1$ |
| $99^{th}$ male | 1016 | 316 | 58.1° | 116.2° | 76.7° | 153.3° | 51.4° | 102.7° |
| $50^{th}$ male | 890 | 306 | 55.5° | 111.0° | 76.0° | 151.9° | 48.8° | 97.5° |
| $1^{st}$ male | 779 | 304 | 52.0° | 104.1° | 74.6° | 149.1° | 45.7° | 91.3° |
| $99^{th}$ female | 916 | 301 | 56.7° | 113.4° | 76.7° | 153.4° | 49.8° | 99.5° |
| $50^{th}$ female | 804 | 285 | 54.7° | 109.3° | 76.7° | 153.5° | 47.6° | 95.3° |
| $1^{st}$ female | 679 | 316 | 47.1° | 94.1° | 71.5° | 143.1° | 41.7° | 83.3° |

Using the estimates from Table 1, the angle $\theta_2$ would, based on the body data, be about 47° to about 58°. Consequently, the angle $\theta_1$ formed by the V-shape of the elastomeric strips on the coveralls 12 would be about 94° to about 116° based merely on the estimates of the human body. When the additional width in the chest is included along with a higher or lower placed V-shape, as shown in Table 1, the range of the angle $\theta_2$ may be from about 42° to about 77° and a range for the V-shape angle $\theta_1$ to be in the range of about 83° to about 154°.

These ranges of angles are approximations of the angles that may be appropriate for the coveralls of the present invention. One skilled in the art would see how such body size data and the pertinent design considerations may lead to angles that may be greater, or lesser, than those estimated here.

The elastomeric materials used in the coveralls 12 of the present invention may be a single-direction stretch material or may be a multi-direction stretch material. A material having a single-direction of stretch is a material that is elastic along a single, prominent axis and will generally not be substantially elastic along the axis perpendicular to such an elastic axis. For example, a single-direction stretch material may be elastic along the machine direction of the material and be substantially inelastic along the cross-machine direction of the material.

A multi-direction stretch material will have some degree of elasticity along more than a single axis of the material. For example, a multi-direction stretch material may have some degree of elasticity along both the machine and cross-machine directions of the material. Even though a multi-direction stretch material may have some degree of elasticity along more than one axis, the material may still have an axis along which the material has a higher degree of elasticity, i.e., a prominent direction of stretch. When using a single-direction stretch material (or a multi-direction stretch material with a dominant direction of stretch) it is desirable that the prominent stretch axis be aligned with the general stretch needs of the garment.

In some embodiments, the coveralls 12 may be constructed such that the prominent direction of stretch for the elastomeric materials is oriented along the direction in which the elastomeric strip 80 is placed. For the coveralls 12 illustrated in FIG. 2, such an elastomeric strip 80 would be cut and placed such that the prominent direction of stretch for the elastomeric material would be oriented substantially parallel to directions generally extending from the lower back point 90 toward the underarms 91, 92.

Alternatively, it may be desirable to cut and orient the elastomeric material such that the prominent direction of stretch is substantially parallel with the back seam 32.

In some embodiments, combinations of stretch direction and a multiple-sectioned elastomeric strip may be used. For example, the elastomeric strip 80 may be made with four discrete sections; it may be similar to the first and second elastomeric strips, 81, 82, as shown in FIG. 2, but where each of the elastomeric strips 81, 82 may each be made of two pieces (not shown). In this example, the portion of the elastomeric strips 81, 82 along the back of the coveralls 12 may be substantially parallel to the back seam 32, while the portion present on the underside 66 of each sleeve may be parallel with the direction from the underarm toward the wrist.

Combinations of single- and multi-direction stretch materials are also contemplated. For example, the coveralls 12 shown in FIG. 3 may be constructed such that the lumbar panel 84 may be a multi-direction stretch material, while the elastomeric strips 81, 82 may be a single-direction stretch material.

The coveralls 12 of the present invention may also include other additional features. In FIG. 1, the coveralls 12 include a neck opening 26 along the shoulder 62 of the coveralls 12. An additional feature for such coveralls 12 may be the addition a collar and/or hood fitted to such a neck opening 26. In some embodiments, such as illustrated in FIG. 3, the coveralls 12 may include an elasticized waistband 17. Another feature may be elastic cuffs added to the leg openings or wrist openings of the garment to ensure that such openings fit snugly against a wearer. Piping may be added to the coveralls of the present invention, to allow for attachment of badges to the coveralls without breaching the integrity of the garment material. Such piping may additionally, or alternatively, be included for aesthetic purposes. Other features such as pockets are also considered. The coveralls may additionally include re-sealable openings to allow a wearer to access the interior of the coveralls without having to remove the coveralls.

The closure means 28 of the coveralls 12 may include any type of fastener as are common for such protective garments. Desirably, the closure means 28 will be a mechanical closure device, such as a standard zipper for barrier protection. However, it is contemplated that other fasteners such as hook-and-loop fasteners, snaps, resealable tapes, or other similar fasteners may be used, depending on the level of protection required of the coveralls.

The coveralls 12 of the present invention may alternatively incorporate an obliquely oriented opening with an associated fastener, across the front torso region of the garment, instead of a conventional vertical opening for entry into the garment. For example, a zipper may start at the shoulder and proceed diagonally across the torso down to the upper thigh region. This allows the torso of the garment to be opened wide. An angled zipper that starts away from the neck of the wearer may be less irritating. The zipper may have a flap covering it. The flap may be secured by a variety of fasteners.

Colors, symbols, words, or logos may be employed to communicate a particular message, such as the relative level of protection, or to provide distinctive appearance as a style element. Colors may be applied to the material of the entire coveralls, individual portions of the coveralls, or as fabric piping along seams, around pockets or leggings, or in distinctive patterns. A logo denoting branding or level of protection may be located on the coveralls. Color may be added to the closure means for communication and appearance purposes.

Generally speaking, the manufacture of such coveralls may be in accordance with known automated, semi-automated, or hand assembly procedures. For example, attachment of the various portions of the garment may be achieved utilizing sewing or stitching, ultrasonic bonding, solvent welding, adhesives, thermal bonding and similar techniques.

According to the present invention, in certain embodiments, all materials used in the protective coveralls have barrier properties that meet industrial standards for their respective designated level of protection. The coveralls materials are generally breathable and liquid resistant barrier materials. The breathability of the material increases the comfort of someone wearing such a garment, especially if the garment is worn under high heat index conditions, vigorous physical activity, or long periods of time. Various suitable woven and non-woven barrier materials are known and used in the art for garments such as surgical gowns, coveralls, industrial protective garments, and the like. All such materials are within the scope of the present invention.

The material used to form the garment may be one or more bonded carded webs, webs of spunbonded fibers, webs of meltblown fibers, webs of spunlaced fibers, webs of other nonwoven materials, one or more knit or woven materials, one or more films, and combinations thereof. The material may be formed from polymers such as, for example, polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins, and mixtures and blends of the same. If the material is formed from a polyolefin, the polyolefin may be polyethylene, polypropylene, polybutene, ethylene copolymers, propylene copolymers and butene copolymers.

Multiple layers of seamless sheet material may be joined into a seamless laminate and used to form coveralls having desirable barrier properties. Laminates can be formed by combining layers of seamless sheet materials with each other and/or forming or depositing layers of such materials on each other. For example, the material may be a laminate of two or more nonwoven webs. As a further example, the material may be a laminate of at least one web of spunbonded fibers and at least one web of meltblown fibers and mixtures thereof.

For example, useful multi-layer materials may be made by joining at least one web of meltblown fibers (which may include meltblown microfibers) with at least one spunbonded continuous filament web. An exemplary multi-layer seamless material useful for making the protective coveralls of the present invention is a nonwoven laminated fabric constructed by bonding together layers of spunbonded continuous filaments webs and webs of meltblown fibers (which may include meltblown microfibers) and may also include a bonded carded web or other nonwoven fabric.

An exemplary three-layer fabric having a first outer ply of a spunbonded web, a middle ply of a meltblown web, and a second outer ply of a spunbonded web may be referred to in shorthand notation as SMS. Such fabrics are described in detail in U.S. Pat. Nos. 4,041,203, 4,374,888, and 4,753,843, all of which patents are assigned to the Kimberly-Clark Corporation, the assignee of the present invention.

An exemplary material which could be used for the manufacture of disposable protective coveralls of the present invention is laminated fabric constructed by bonding together at least one layer of a nonwoven web with at least one layer of a film. Generally speaking, the film layer may range in thickness from about 0.25 mil to about 5.0 mil. For example, the film will have a thickness ranging from about 0.5 mil to about 3.0 mil. Desirably, the film will have a thickness ranging from about 1.0 mil to about 2.5 mil.

Exemplary film layers include films formed from polymers which may include polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins. If the film layer is made of a polyolefin, the polyolefin may be polyethylene, polypropylene, polybutene, ethylene copolymers, propylene copolymers and butene copolymers and blends of the above.

According to the invention, the seamless sheet material of the coveralls 12 of the present invention may have a basis weight ranging from about 15 gsm (i.e., grams per square meter) to about 300 gsm. For example, the seamless sheet material may have a basis weight ranging from about 20 gsm to about 100 gsm. Desirably, the material may have a basis weight ranging from about 20 gsm to about 75 gsm.

For example, the material may be made from various forms of calendared nonwoven materials, such as Dupont Tyvek® brand high-density polyethylene materials. Garments made of Tyvek® have been used for hazardous environments or for general, non-hazardous, industrial use. Examples of uses for hazardous environments include protection against water-based acids, bases, salts and splashes of certain liquids, such as pesticides and herbicides. The garments also provide a reliable barrier against exposure to harmful dry particles, such as lead dust, asbestos and particles contaminated with radiation. Non-hazardous, industrial uses include wearing the garments for "dirty jobs" at factories, workshops, engineering plants, farms and construction sites.

The resistance hydrostatic pressure (hydrohead) of the protective articles will depend, in part, on the particular kind of material from which the article is constructed. The coveralls may be designed to have a liquid hydrohead resistance of at least about 15, 17 or 20 millibars, up to about 180, 187, or 200 millibars, inclusive of all range combinations thereinbetween. More commonly, the coveralls may have a hydrohead resistance of about 25 or 30 to about 115 millibars, preferably between about 45 to about 110 millibars, and more preferably between about 50 millibars to about 95 millibars of pressure.

The air permeability of the coveralls materials, may range from at least about 2 cubic feet per meter (cfm) up to about 47 or 50 cfm, inclusive of all range combinations therein-between. More typically, the air permeability may be in the range from about 5 or 10 cfm to about 43 or 45 cfm, and preferably between about 15, 17, 20, or 25 cfm to about 40 or 42 cfm.

The coveralls may have a moisture vapor transmission rate (MVTR) of up to about 4700 $g/m^2/24$ hours, more typically about between about 2700 or 3600 MVTR to about 4500 or 4600 MVTR. The protective coveralls may protect the wearer resistance of about 9-100% against dry particle barrier intrusion of a particle size of 0.3-05 microns.

The coveralls may be made from a material that provides a barrier to dust and microparticulates (e.g., ranging in size from about 0.05-0.10 microns or larger (see, e.g., U.S. Pat. No. 5,491,753) or light-splash fluids. The materials of the coveralls may also be electret-treated to generate a localized electrostatic charge within the fibers of the nonwoven web (e.g., U.S. Pat. No. 5,401,446 to Tsai). For example, these materials may be treated with compositions such as Zepel® and Zelec®, available from E. I. du Pont De Nemours, located in Wilmington, Del.

Various elastomeric materials are known in the art that may be used for the elastomeric strip 80. The elastomeric materials may, for example, be composed of a single layer, multiple layers, laminates, spunbond fabrics, films, melt-blown fabrics, elastic netting, microporous web, bonded carded webs or foams comprised of elastomeric or polymeric woven or nonwoven. Elastomeric nonwoven laminate webs may include a nonwoven material joined to one or more gatherable nonwoven webs, films, or foams. Stretch-bonded-laminates (SBL) and necked-bonded-laminates (NBL) are examples of elastomeric nonwoven laminate webs. Elastomeric materials may include cast or blown films, foams, or nonwoven fabrics composed of polyethylene, polypropylene, or polyolefin copolymers, as well as combinations thereof. The elastomeric materials may include elastic polyolefins such as Vistamaxx® (available from Exxon-Mobil, located in Houston, Tex.), VERSIFY® (available from Dow Chemical, located in Midland, Mich.), polyether block amides such as PEBAX® elastomer (available from AtoChem located in Philadelphia, Pa.), thermoplastic polyurethanes (e.g., both aliphatic-polyether and aliphatic-polyester types), HYTREL® elastomeric copolyester (available from E. I. DuPont de Nemours located in Wilmington, Del.), KRATON® elastomer (available from Shell Chemical Company located in Houston, Tex.), or strands of LYCRA® elastomer (available from E. I. DuPont de Nemous located in Wilmington, Del.), or the like, as well as combinations thereof. The elastomeric strips 80,82 may include materials that have elastomeric properties through a mechanical process, printing process, heating process, or chemical treatment. For examples such materials may be apertured, creped, neck-stretched, heat activated, embossed, and micro-strained; and may be in the form of films, webs, and laminates

EXAMPLE

An example of the protective coveralls of the present invention was produced for testing (Code A). The materials and design of the coveralls were the same design as is sold by Kimberly-Clark Professional, located in Roswell, Ga., as the KLEENGUARD® A30 Coveralls. The materials used for the body of the A30 design for both Codes A and B was a 1.8 $oz/yd^2$ (61 $g/m^2$) polypropylene SMS material. The A30 design was modified to include the elastomeric strips as shown in FIGS. 1 and 2. The strips were 3 inches wide and were present on the coveralls with the V-shape angle of 130° (measured with the coveralls held flat).

The elastomeric material used in Code A was made similarly to the necked-bonded laminate as taught by U.S. Pat. Nos. 4,965,122; 4,981,747; 5,226,992; and 5,336,545. Rather than extrusion coating the facing with an elastomeric film, the elastomeric material made with two necked facings of polypropylene spunbond material that were thermally bonded to an elastomeric film layer between the two facing layers. The spunbond facing layers each had a starting basis weight of 0.75 $oz/yd^2$ (25.4 $g/m^2$) and were necked 50 percent to produce a final basis weight of 1.4 $oz/yd^2$ (47.5 $g/m^2$). The resultant material had an elongation of approximately 85 percent elongation.

The elastomeric material was stretched to near its ultimate elongation as it was joined to the edges of the body portions and leg portions, as shown and described for FIG. 2, using serged seams. The resultant elastomeric strips retracted along the seams of the garment approximately 9 percent when the coveralls relaxed (i.e., 100 mm of material as sewn into the garment retracted to a length of 91 mm). This allowed the elastomeric strip and coveralls to stretch around 10 to 15 percent along the elastomeric strip (i.e., 100 mm of elastomeric strip incorporated into the coveralls extended to approximately 110-115 mm).

For the purposes of comparison, a second garment (Code B) was produced. The second garment (Code B) was similarly base on the KLEENGUARD® A30 Coveralls. The Code B coveralls were modified to include the V-shaped insert configured in the same way as the elastomeric strips of the inventive coveralls (Code A). However, the V-shaped insert was made of same material that made up the body of the coveralls, as opposed to the elastomeric material used in Code A. The intention of the second garment (Code B) was to provide a garment similar to currently available coveralls that could serve as a direct comparison to the first garment (Code A).

Finally, a third garment was included in the testing as a competitive comparison. The third garment (Code C) was a DuPont™ TYVEK® coveralls (Product No. TY125S) available from E. I. du Pont de Nemours, located in Wilmington, Del.

The three garments were tested in use with three different test methods. Each garment was compared against baseline measurements taken before the test subject donned the test garments. Such differences (test code versus baseline) were then used to compare the individual test garments.

Twenty-one test subjects, of various weights and heights, tested each of the three test codes. Table 2 describes the weight and height distribution of the test subjects. Each test subject tested coveralls appropriate for the subject's size, as suggested by the manufacturer. For those test subjects that fell in between recommended sizes, the larger sized coveralls were selected to ensure easy movement.

TABLE 2

| | Mean | $5^{th}$ %-tile | $25^{th}$ %-tile | Median | $75^{th}$ %-tile | $95^{th}$ %-tile | Min | Max |
|---|---|---|---|---|---|---|---|---|
| Weight (lbs.) | 188.86 | 29.71 | 158.50 | 186.00 | 209.00 | 234.00 | 153 | 259 |
| Height (in.) | 71.05 | 65.50 | 68.00 | 72.00 | 74.00 | 75.75 | 64.50 | 81.00 |

Only one garment code was tested, per subject, per test day; the actual garment code tested on a given day was randomized for the test subjects. All three test protocols (wall reach, high reach, and productivity) were performed for each garment on each garment test day. A baseline measurement for each test was taken each day, prior to the subject donning that day's assigned garment.

On each test day, the test subject was prepared prior to the start of the testing. Each test subject donned a t-shirt and medical scrub pants supplied to them along with their own closed-toe, closed-heel athletic shoes and socks. Before testing, each subject was put through light stretching exercises.

The stretching began by the subject placing their right arm over their left arm, as far as possible with elbows straight, and held the position for five seconds before relaxing. Subjects then crossed their left arm over their right arm, in the same manner, and held the position for five seconds before relaxing. Two additional cycles of each arm cross hold were then performed. Subjects then were instructed to lean forward at the waist and stretch their arms outward as far forward as possible; hold the position for five seconds; relax; and repeat three times, trying to reach further each time. Finally, the subjects were instructed to reach both arms over head and stretch their arms toward the ceiling as far as possible, hold the position for five seconds, relax, and repeat two more times.

The test subject then performed each of the three test protocols prior to donning the test garment, as a baseline. After performing the baseline testing, the subject then donned the test coverall and the garment was zipped completely to the top. The test administrator securely taped the wrist cuffs of the test garment to the skin of the test subject, at the point where the cuff naturally fell on the test subject when the test subject's arms were held out in front of their bodies. Then, the test subject again performed all three of the testing protocols.

Wall Reach Test:

Each test subject stood in front of a wall with their legs hip distance apart. The subject then bent forward at the waist and reached their arms forward to touch their finger tips to the wall, their arms remaining level with their shoulders. The subject was moved toward, or back from, the wall such that the subject could touch the wall when bending forward, but not so close that they put pressure on the wall. A floor mark was made at the distance the subject's toes were from the wall. The subject was then given a three-pound (1.36 kg) weight and they again reached toward the wall while grasping the weight with both hands. The distance from the wall-facing edge of the weight to wall was recorded as the baseline measurement.

After the test coveralls were donned, the test subject was again placed in front of the wall with their toes at the floor mark previously made. The subject was then again given the three-pound weight, which they grasped with both hands and reached toward the wall, bending at the waist with arms level with their shoulders. The subjects were asked to not reach any further, if any tugging or pulling occurred at the wrist or if the tape started to pull off the wrist. The distance between the wall and the front edge of the weight was then recorded.

High Reach Test:

Each subject stood flush against a wall with their forehead touching the wall and their toes approximately hip distance apart and touching the wall. The subject then reached as high as possible on the wall with their dominant hand, without raising their heels off the floor. Their highest reach was then marked on the wall, and was recorded as the baseline measurement.

After the subject donned the test garment, the subject repeated the high reach procedure. The subjects were asked to not reach any further if any tugging or pulling occurred at the wrist or if the tape started to pull off the wrist. The distance from their reach when wearing the test coveralls to the baseline mark was then recorded.

Productivity Test:

The productivity test measured the time required for the subject to complete a series of physical tasks. The times required while the subject was wearing the test garments was compared with the (baseline) time required to complete the tasks when not wearing a test garment.

Each subject set a baseline by standing in front of the shelving unit with their toes touching the bottom of the shelving unit. The shelving unit had a top shelf that was 68.5 inches (1.74 m) above the floor and a lower shelf that was 52.75 inches (1.34 m) above the floor. The subject held a weighted paint can (paint can with a three-pound hand weight inside) by the handle, reaching as far back as possible on the top shelf. A mark was made on the shelf where the front edge of the can hit the shelf. During the test, the subject would place the paint cans on the shelf behind this line.

Six paint cans were set upon the floor with a three-pound (1.36 kg) hand weight in each can and the cover of each can securely on the can. The cans were placed 64 inches (1.63 m) from the bottom of the shelving unit. The handles of the cans were placed in the down position and facing the same side of the can as the subject's dominant hand.

The test started with test subject placing their non-dominant behind their back. The timer was started when the subject lifted the first paint can. Using their dominant hand, the subject lifted the first paint can by the handle, carried it over to the shelving unit and placed it on the top shelf behind the placement mark on the shelf. The subject then proceeded to pick up and place the remaining cans on the shelf in the same manner, one can at a time, and returning to the starting position to retrieve each can.

The subject then removed the lids and placed them on the shelf below the cans, each placed next to each other on the lower shelf, moving from left to right. The subject then moved each can from the top shelf back to the starting position on the floor, one can at a time, in numbered sequence. Next, the subject again moved the six cans back to the top shelf, one can at a time, and the lid for each can was securely place back on the appropriate cans. Finally, the subject moved the lidded cans back to the appropriate starting position on the floor. The first cycle is completed when the sixth can has been placed on the floor. The subject then repeated the steps for a second cycle. The time was recorded at the end of the first cycle and the timer was stopped at the end of the second cycle. Throughout the testing cycles, the test administrator encouraged the subject to maintain their pace and helped guide them through the process.

A baseline time for the first and second cycle was recorded for the test subject performing the productivity test prior to donning the test coverall. The test subject was later repeated the test while wearing the test coverall.

The results of the three tests are given below in Table 3. The wall reach data is reported as the difference of the wall reach test before donning the coveralls (baseline) less the same measurement while wearing the test coveralls; smaller differences are desired. Similarly, the high reach data is reported as the difference of the high reach test before donning the coveralls (baseline) less the same measurement while wearing the test coveralls; smaller differences are desired. Finally, the productivity data is reported as the difference between the time the tasks took while wearing the test coveralls less the time (in seconds) it took to complete the tasks without the coveralls. The productivity differences are reported for both the first cycle and the second cycle of the productivity test; a shorter time is desired.

TABLE 3

| | Wall Reach (inches) | | High Reach (inches) | | Productivity - 1st cycle (s) | | Productivity - 2nd Cycle (s) | |
|---|---|---|---|---|---|---|---|---|
| Coveralls | Mean | Std. Dev. | Mean | Std. Dev. | Mean | Std. Dev. | Mean | Std. Dev. |
| Code A | 3.63 | 2.19 | 2.88 | 2.41 | 14.76 | 51.72 | 14.38 | 72.84 |
| Code B | 5.04 | 2.99 | 3.69 | 2.59 | 39.90 | 55.75 | 80.86 | 110.82 |
| Code C | 4.81 | 2.55 | 1.73 | 2.02 | 27.43 | 56.76 | 55.52 | 111.00 |

As can be seen in the results of Table 3, the coveralls of the present invention (Code A) preformed directionally better than the same coveralls without the elastomeric strips (Code B) in every measure. The coveralls of the present invention also performed directionally better than the competitive comparison coveralls (Code C) in both the wall reach test and the productivity test.

The competitive comparison coveralls performed directionally better than the coveralls of the present invention in the high reach test. Such results are attributed to the increased space present in the torso and the seat of the competitive comparison coveralls that is not present in the coveralls of the present invention.

Such testing results show that the angled elastomeric strip present on protective coveralls improves the ability of the wearer to move compared to coveralls lacking such an angled elastomeric strip. Such an angled elastomeric strip allows for stretch and movement in a multitude of directions without the use of larger elastomeric panels. Additionally, the angled elastomeric strips accommodate stretching, bending, and other movements that simultaneously engages multiple areas of stress in the coveralls, as opposed to multiple, individual elastic panels placed in various places on the garment.

The present invention has been described in general and in detail by way of examples. Persons of skill in the art understand that the invention is not limited to the specific embodiments disclosed. Modification and variations of the general concept may be made without departing from the scope of the invention as defined by the following claims or equivalents, including, equivalent components.

We claim:

1. A disposable protective garment for a wearer, the disposable protective garment comprising: a body comprising a body portion formed from a barrier fabric having a holdout efficiency of at least 40% for particles having a diameter greater than 0.1 micron, the body portion comprising a front side, a back side comprising a central back seam and a lower back portion, and an upper portion, and a neck opening; a right leg and a left leg, both legs extending from the body portion, a crotch formed at a point where each of the right leg and the left leg meet the front side and the back side of the body portion; a closure extending from the neck opening on the front side of the body portion toward the crotch; a right sleeve and a left sleeve, both the right sleeve and the left sleeve extending from the body portion, both sleeves comprising an underside, both sleeves being attached to and extending from the upper portion, a left underarm formed where the underside of the left sleeve is joined to the upper portion, and a right underarm formed where the underside of the right sleeve is joined to the upper portion; and a V-shaped elastomeric strip comprising an apex and a first extension and a second extension, the V-shaped elastomeric strip positioned on the back side of the body portion, the apex being positioned no lower than the lower back portion and substantially in alignment with the central back seam, the first extension of the V-shaped elastomeric strip extending from the apex toward the left underarm and the second extension of the V-shaped elastomeric strip extending from the apex toward the right underarm, wherein the V-shaped elastomeric strip permits the wearer to reach and bend; wherein the first and second extensions of the V-shaped elastomeric strip have been attached to the body portion of the garment while being held in a stretched configuration and then allowed to retract after attachment; and wherein the barrier fabric forming at least the entire front side of the body portion is non-elastomeric.

2. The garment of claim 1, wherein the V-shaped elastomeric strip is formed from an elastomeric nonwoven laminate.

3. The garment of claim 1, wherein the V-shaped elastomeric strip is comprised of a laminate including a nonwoven material joined to an elastomeric film or nonwoven web.

4. The garment of claim 1, wherein the V-shaped elastomeric strip comprises a stretch-bonded laminate.

5. The garment of claim 1, wherein the V-shaped elastomeric strip comprises a necked-bonded laminate.

6. The garment of claim 1, where the V-shaped elastomeric strip is a continuous strip of elastomeric material without a seam spanning across the strip.

7. The garment of claim 1, where the V-shaped elastomeric strip is between 2 and 6 inches wide and has an elastic elongation between 25 percent and 400 percent.

8. The garment of claim 7, where the V-shaped elastomeric strip is between 2 and 4 inches wide.

9. The garment of claim 1, where the V-shaped elastomeric strip is oriented upon the garment such that, when the garment is held flat, an angle formed by the first extension and the second extension of the V-shaped elastomeric strip is between 83 degrees to 155 degrees.

10. The garment of claim 1, where one the second extension extends to the right underarm and along the underside of the right sleeve, and where the first extension extends to the left underarm and along the underside of the left sleeve.

11. The garment of claim 10, where the second extension extends along the underside of the right sleeve to a right wrist, and where the first extension extends along the underside of the left sleeve to the left wrist.

12. The coverall of claim 1, where the second extension extends along the back side of the right sleeve, and where the first extension extends along the back side of the left sleeve.

13. The coverall of claim 1, where the second extension extends along the upper edge of the right sleeve, and where the first extension extends along the upper edge of the left sleeve.

14. The garment of claim 1, wherein the front side of the body portion is divided into a right side and a left side, further wherein the garment comprises a right panel and a left panel, the right panel comprising the right leg and the right side of the front side of the body portion formed from a seamless sheet of the barrier fabric, the left panel comprising the left leg and the left side of the front side of the body portion formed from a seamless sheet of the barrier fabric.

15. The garment of claim 14, wherein the right panel and the left panel are substantially mirror images of each other.

16. The garment of claim 14, wherein the right panel further comprises the right sleeve and the left panel further comprises the left sleeve.

17. A disposable protective garment for a wearer, the disposable protective garment comprising: a body comprising a body portion having a left body panel and a right body panel, both the left body panel and right body panel having a front side, a back side, and an upper portion, where a central back seam joins the back side of the left body panel to the back side of the right body panel, and where the left body panel and the right body panel define a lower back portion and a neck opening; a right leg extending from the right body panel and a left leg extending from the left body panel, a crotch formed at a point where the right leg, the left leg and the body portion meet on both the front side and the back side of the left body panel and the right body panel; a right sleeve and a left sleeve, the right sleeve extending from the right body panel and the left sleeve extending from the left body panel, both sleeves comprising an underside, both sleeves being attached to and extending from the upper portion, a left underarm formed where the underside of the left sleeve is joined to the upper portion of the left body panel, and a right underarm formed where the underside of the right sleeve is joined to the upper portion of the right body panel; and a V-shaped elastomeric strip comprising an apex and a first extension and a second extension, the V-shaped elastomeric strip positioned on the back side of the right body panel and the back side of the left body panel, the apex being positioned no lower than the lower back portion and substantially in alignment with the central back seam, the first extension of the V-shaped elastomeric strip extending from the apex toward the left underarm and the second extension of the V-shaped elastomeric strip extending from the apex toward the right underarm; wherein a single closure extends from the neck opening on a front side of the garment toward the crotch, so as to join the left body panel to the right body panel; and wherein at least the entire front side of the left body panel and the right body panel is formed from a non-elastomeric barrier fabric.

18. The garment of claim 17, wherein the single closure is a single zipper extending continuously from the neck opening towards the crotch.

19. A disposable protective garment for a wearer, the disposable protective garment comprising: a body comprising a body portion formed from a barrier fabric having a liquid hydrohead resistance of from 15 millibars up to 200 millibars, the body portion comprising a front side, a back side comprising a central back seam and a lower back portion, and an upper portion, and a neck opening; a right leg and a left leg, both legs extending from the body portion, a crotch formed at a point where each of the right leg and the left leg meet the front side and the back side of the body portion; a closure extending from the neck opening on the front side of the body portion toward the crotch; a right sleeve and a left sleeve, both the right sleeve and the left sleeve extending from the body portion, both sleeves comprising an underside, a left underarm formed where the underside of the left sleeve is joined to the upper portion, and a right underarm formed where the underside of the right sleeve is joined to the upper portion; and a V-shaped elastomeric strip comprising an apex and a first extension and a second extension, the V-shaped elastomeric strip positioned on the back side of the body portion, the apex being positioned no lower than the lower back portion and substantially in alignment with the central back seam, the first extension of the V-shaped elastomeric strip extending from the apex toward the left underarm and the second extension of the V-shaped elastomeric strip extending from the apex toward the right underarm; wherein the first and second extensions of the V-shaped elastomeric strip have been attached to the body portion of the garment while being held in a stretched configuration and then allowed to retract after attachment; and wherein the barrier fabric forming at least the entire front side of the body portion is non-elastomeric.

* * * * *